US005546770A

United States Patent [19]

Nanya

[11] Patent Number: 5,546,770

[45] Date of Patent: Aug. 20, 1996

[54] KNITTING PARTS OF KNITTING MACHINE

[75] Inventor: Takanori Nanya, Sayama, Japan

[73] Assignee: Citizen Watch Co., Ltd., Tokyo, Japan

[21] Appl. No.: 338,526

[22] PCT Filed: Apr. 5, 1994

[86] PCT No.: PCT/JP94/00566

§ 371 Date: Nov. 30, 1994

§ 102(e) Date: Nov. 30, 1994

[87] PCT Pub. No.: WO94/23105

PCT Pub. Date: Oct. 13, 1994

[30] Foreign Application Priority Data

Apr. 6, 1993 [JP] Japan ..... 5-022458

[51] Int. Cl.[6] ..... D04B 15/00

[52] U.S. Cl. ..... 66/116; 66/115; 66/123

[58] Field of Search ..... 66/119, 120, 121, 66/122, 123, 115, 116, 117

[56] References Cited

U.S. PATENT DOCUMENTS

| | | | |
|---|---|---|---|
| 3,882,695 | 5/1975 | Flicker | 66/115 |
| 5,077,990 | 1/1992 | Plath | 66/123 |

FOREIGN PATENT DOCUMENTS

| | | |
|---|---|---|
| 304788 | 7/1982 | Germany . |
| 3237851 | 4/1983 | Germany . |
| 58-31141 | 2/1983 | Japan . |
| 118694 | 11/1983 | Japan . |
| 60-52658 | 3/1985 | Japan . |
| 1106494 | 5/1986 | Japan . |
| 61-186558 | 8/1986 | Japan . |
| 62-28452 | 2/1987 | Japan . |
| 4-41755 | 2/1992 | Japan . |
| 86/00093 | 1/1986 | WIPO . |

*Primary Examiner*—John J. Calvert
*Attorney, Agent, or Firm*—Armstrong, Westerman, Hattori, McLeland & Naughton

[57] ABSTRACT

In knitting parts (a guide, needle, tongue, sinker, separator, jacquard guide needle and the like) of a knitting machine, a covering of a hard carbon film 15 of a preset film thickness d on a surface of a portion of a parts base material 10 frequently contacting with knitting yarn and, at the same time, a film thickness changing area 16 where the film thickness of the hard carbon film decreases gradually is formed from an area where the covering of the hard carbon film 15 of the preset film thickness d is formed to an area where such a covering is not formed. A ratio (L/d) between length L of the film thickness changing area 16 toward a film changing direction and the preset film thickness d of the hard carbon film 15 is controlled to be at least 5:1.

2 Claims, 1 Drawing Sheet

KNITTING PARTS OF KNITTING MACHINE

BACKGROUND OF THE INVENTION

1. Field of the Invention

This invention relates to knitting parts such as a guide, needle, tongue, sinker, separator, jacquard guide needle and the like which have a portion contacting with knitting yarn when the parts are fitted to a knitting machine to perform knitting, and particularly to surface covering technology to improve the durability of such parts.

2. Description of the Related Art

The present invention will be described using a warp knitting machine as an example, though knitting machines may include a warp-, flat- and circular knitting machine and the like, and similarly it can be applied to such a flat- or circular machine.

The warp knitting machine is roughly classified into tricot and raschel machines, on which a sectional beam wound with knitting yarn or warp end is usually mounted, the warp end being supplied therefrom to a knitting needle line to perform knitting.

The knitting parts (tool) consisting of a knitting section of a warp knitting machine comprise a thin sheet formed "guide" of about 200 μm thick which is located between a sectional beam and a knitting needle line and has a hole to guide knitting yarn or warp end, a thin sheet-formed "needle" with a hook on a head end for knitted stitch formation, and a thin sheet-formed "tongue", which cooperatively participates in the knitted stitch formation together with the needle, and "sinker", as well as "separator", "jacquard guide needle", etc., in general, a number of such parts being arranged parallel at very close spaces to form a block.

Generally, from viewpoints of easy processing and wear resistance, a carbon steel base material shaped to profile each of these parts is coated by means of wet chromium plating and used as various knitting parts described above.

The durability of such knitting parts, however, has been in serious question due to speeding up of knitting machines, diversification of materials for knitting yarn such as high strength fibers or modified fibers and employment of various kinds of sizes.

Namely, the knitting parts such as the guide, needle, tongue, sinker, separator, jacquard guide needle, etc. tend to be worn out at the portion contacting with the knitting yarn, which would cause hairiness or end breakage of the yarn, and thus the durability of such parts is an important factor in deciding the operational effectiveness of machines and the cost of products because it requires a great deal of expense, effort and time to replace a great number of these parts used in a machine so as to prevent such a trouble of the yarn described above.

It has been proposed to coat the surface of knitting parts (tool) for warp knitting machines with high hardness covering of metals such as tantalum (Ta), tungsten (W), titanium nitride(TiN), titanium-tungsten alloy (TiW), etc. (see Japanese Laid-Open Patent No. 4-41,755).

It has also been known, however, that wearing of knitting parts typically represented by the needle or guide is a phenomenon caused by kinds of fibers, impact pressure, vibration characteristics, etc., and that satisfied results are not necessarily obtained by a covering of high surface hardness.

In fact, in the case of a needle or guide covered with titanium nitride which is known as a covering of a high hardness compound, no increase in durability was observed, compared with a conventional one covered by means of chromium plating on a surface of carbon steel base material, and caused a problem in that the substrate was softened due to a higher treating temperature.

Further, it is also reported that the toughness of a base material itself is lost and, as a result, durability is decreased on the contrary when a covering of high hardness is thickly formed on the base material. From this point of view, it is necessary to improve the durability without spoiling inherent properties of the base material.

Upon this, the inventors have confirmed it effective to form a hard carbon film covering on a surface of base material of knitting parts of knitting machine such as a needle, guide and the like thereby markedly improving durability compared with conventional parts covered only by chromium plating.

However, it is very ineffective to cover the surface of each knitting part with the hard carbon film by means of a vapor phase film forming method such as plasma CVD (Chemical Vapor Deposition) method, because a broader plasma space is required for each part.

Accordingly, it is assumed that, if any measure as to abrasion resistance is taken only on a portion of each knitting part contacting with knitting yarn, durability is sufficiently improved and a bulk handling thereof in a lump becomes feasible during a vapor phase film forming step, which should be considerably productive.

In order to partially cover the surface of parts by the vapor phase film forming method, in general a metal mask is mechanically contacted with the surface of parts or a resist is formed on a portion where the covering is not to be applied so as to cover as a whole, followed by a lift-off of the mask or the resist thus applied, which would result in a steep difference on the surface of parts between a covered and uncovered layer portions.

While the knitting yarn is knitted at high speed with dancing, the yarn does not always contact with a constant portion on the surface of parts but comes into contact irregularly over a wide range of the surface of parts where durability is required. Consequently, such a problem would happen, even in a portion where durability is not so much required, that the knitting yarn is caught in the steep difference in layer due to covered and uncovered portions to cause a hairiness or end breakage thereof.

Accordingly, present invention has been developed in view of the technical background described above, and it is an object of this invention to provide knitting parts of a knitting machine having markedly improved durability and excellent productivity without causing any hairiness nor end breakage.

SUMMARY OF THE INVENTION

In order to achieve the above described object, the present invention provides knitting parts of a knitting machine which have a portion contacting with knitting yarn when the parts are fitted to the knitting machine to perform knitting which comprises forming a covering of a hard carbon film of a preset film thickness on a surface of a portion of a base material frequently contacting with the knitting yarn and, at the same time, forming a film thickness changing area where the film thickness of the hard carbon film decreases gradually from an area where the covering of the hard carbon film of preset thickness is formed to an area where such a covering is not formed. Preferably, a ratio between the length of the film thickness changing area toward a film thickness changing direction and the preset thickness of the hard carbon film is at least 5:1.

In this manner, the covering of hard carbon film of preset thickness is formed on the surface of that portion of the base material comprised of the knitting parts of knitting machine, which portion contacts frequently contacts with the knitting yarn, thereby markedly improving durability.

The present hard carbon film refers to a amorphous one that contains hydrogen and is formed by means of a vapor phase film forming method such as plasma CVD method in an atmosphere of hydrocarbon gas.

When the knitting parts of this invention are covered with the hard carbon film by means of a vapor phase film forming method such as the CVD method, the plasma space is only required for the part base material frequently contacting with the knitting yarn and for a vicinity thereof, and accordingly, a large quantity of parts can be subjected to a film forming treatment all at once, thereby considerably increasing the productivity being compared with a formation of the hard carbon film throughout the surface of the part base material.

Further, as the film thickness changing area where the thickness of the hard carbon film gradually decreases from an area where the covering of the hard carbon film in the predetermined film thickness to the area where such a covering is not formed, knitting is performed while the knitting yarn is dancing without resulting in the steep difference in thickness on a part of the parts surface including a surface where durability of the parts base material is required, thereby the knitting yarn is never caught to cause hairiness or end breaking even when the yarn contacts randomly with the parts surface over a wide range thereof.

When the hard carbon film is applied on the surface of the parts base material by means of plasma CVD method, a portion of the surface of the base material where the film covering is not required is used to hold the parts base material, while a portion of the surface where the film coveting is required is subjected to plasma directly. At this time, from the surface where the film covering is required to the surface not required thereof, a mask is applied at a certain distance from the surface of the parts base material, thereby the hard carbon film being capable of a gradual decrease in the film thickness from the surface where the covering of hard carbon film is required to the surface not required thereof.

DETAILED DESCRIPTION OF THE PREFERRED EMBODIMENT

Referring now to the attached drawings, this invention will be further described using a "needle" by way of example of a typical knitting part of a knitting machine.

Figure 2:
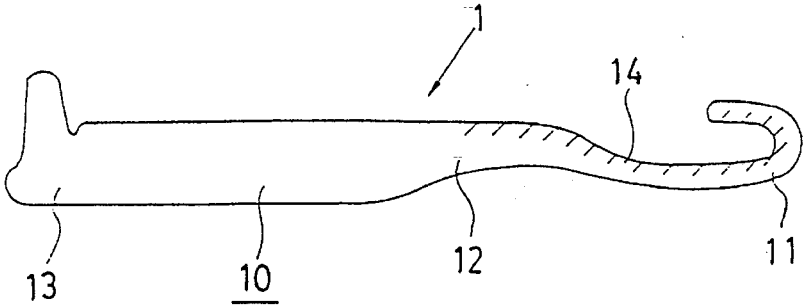
FIG. 2 is a plan view similarly showing a surface portion of the needle frequently contacting with knitting yarn.

FIG. 2 is a plan view of the needle. A hook 11 to catch knitting yarn, a stem 12, and a fixing edge 13 to fix thereof to a fixture are monolithically molded by a needle base material 10 such as carbon steel to form the needle 1.

Figure 1:
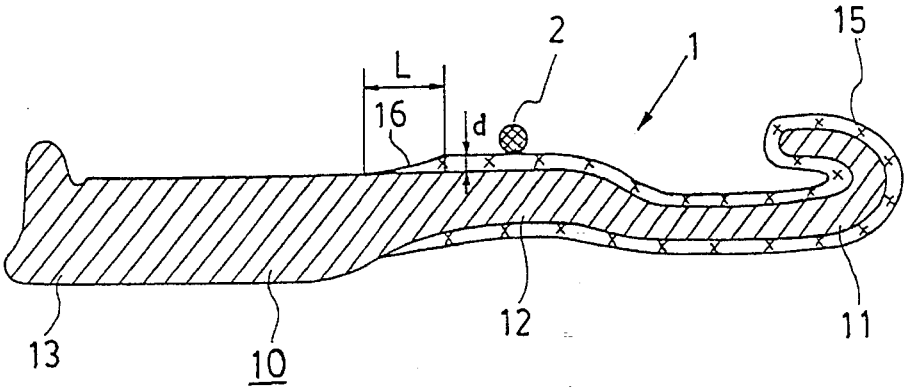
FIG. 1 is a typical sectional view of a needle, one of knitting parts of knitting machine showed as an example of this invention.

When the needle 1 is fitted to a knitting machine to perform knitting, knitted stitches are formed while the knitting yarn 2 shown in FIG. 1 moves from a portion close to the hook 11 of the stem 12 to an inner periphery of the hook 11, thereby a surface in a range of a shaded portion 14 in FIG. 2 frequently contacting with the knitting yarn 2 is subjected to the severest friction.

Although it would be effective from a viewpoint of durability improvement that the hard carbon film is applied at least to a surface of the needle base material 10 included in this portion 14, the hard carbon film should be applied so as not to result in a steep difference in thickness in an area expected to contact with the knitting yarn 2 because the yarn 2 tends to contact with a wider surface including this range.

Accordingly, a covering of the hard carbon film 15 having a preset film thickness d is formed, as shown in FIG. 1, on the surface of the shaded portion 14 in FIG. 2 of the needle base material 10 frequently contacting with the knitting yarn at least from the hook 11 to the stem 12 of the needle 1.

Further, a film thickness changing area 16 where the film thickness of the hard carbon film is gradually decreasing is formed from an area where a covering of the hard carbon film 15 having the preset thickness d is formed on the surface of the needle base material 10 to an area where such a covering is not formed. When the length of the film thickness changing direction in the film thickness changing area 16 is expressed as L, a ratio thereof to the preset film thickness d of the hard carbon film (L/d) is preferably at least 5:1.

Figure 3:
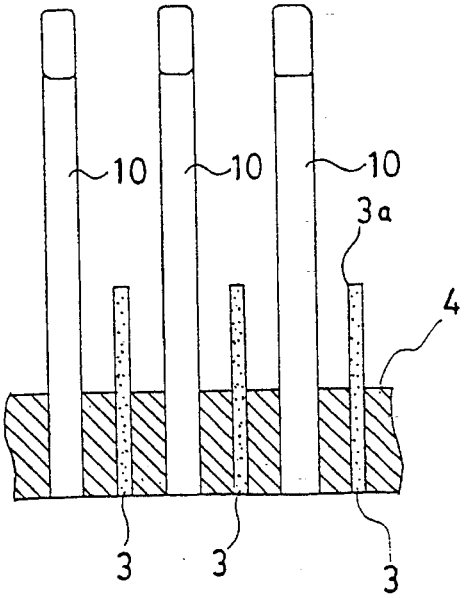
FIG. 3 is a typical view showing a holding condition of needle base materials and masks by means of a film forming jig when a coveting of hard carbon film is formed on a portion of surface contacting with knitting yarn on the surface of needle.

Referring now to FIG. 3, a covering process of the hard carbon film on the surface of the needle base material 10 will be described in the following.

Carbon steel is generally used as the needle base material 10 from view points of easy processing, hardness, toughness and the like. Keeping a constant face distance with masks 3, a plurality of the needle base materials 10 are arranged in parallel and held by means of a jig 4 as shown in FIG. 3.

The needle base material thus held was placed as it is in a vacuum equipment for evacuation followed by impressing minus DC voltage to the needle base material 10 by use of, for example, a DC (direct current) plasma CVD method to apply the hard carbon film 15 under a condition shown in the following.

| <bombardment condition > | |
|---|---|
| kind of gas | argon (Ar) gas |
| degree of vacuum | $3 \times 10^{-3}$ Torr |
| DC voltage | −5 KV |
| time period | 5 minutes |
| <formation condition > | |
| kind of gas | benzene gas |
| film forming pressure | $5 \times 10^{-3}$ Torr |
| DC voltage | −3 KV |
| film thickness | 1 μm |

As a result of a treatment under the condition described above, the surface of needle base material 10 from the hook 11 to the stem 12 is covered with the hard carbon film 15 of the preset thickness (d=1 μm), while the surface of the needle base material 10 facing to the mask 3 each other is covered with the hard carbon film thinner than the preset film thickness except an area contacting with the jig 4.

When a distance between the needle base material 10 and the mask 3 is changed, the film thickness of the hard carbon film is gradually decreased to change a covering-around property from a surface of the needle base material 10 facing to a mask edge 3*a* to a surface thereof on a side of the jig 4.

Herein, a covering-around distance from the surface of the needle base material 10 facing to the mask edge 3*a* to a portion where the hard carbon film is not formed (which corresponds to the length L of the film thickness changing direction of the film thickness changing area 16 shown in FIG. 1) is defined as a change in width. A distance between the needle base material 10 and the mask 3 and a relationship between the change in width L and the preset film thickness d, when the surface of the needle base material 10 was covered with the hard carbon film 15 of the preset film thickness d from the hook 11 to the stem 12, as well as a correspondence thereof to durability test results were examined. The result thus obtained is shown in Table 1.

As a result, it was confirmed that conventional problems such as hairiness and end breakage never occur if a covering having a smooth gradient of change is formed so as to control the ratio of the change in width L to the preset film thickness d, L/d, to be at least 5:1.

TABLE 1

| distance between base material and mask | change in width/ preset film thickness | durability test result |
|---|---|---|
| 0 mm | 0 μm/1 μm | × end breakage |
| 1 | 2 μm/1 μm | Δ hairiness |
| 2 | 5 μm/1 μm | ○ |
| ↑ | 10 μm/1 μm | ○ |
| ≧3 | ≧10 μm/1 μm | ○ |

While this invention has been described in the above example with regard to the needle as a knitting part of knitting machine, a similar effect can also be obtained in cases of other knitting parts such as a guide, tongue, sinker, separator, jacquard guide needle and the like, by forming the covering of the hard carbon film on the surface of the area where each of such parts base materials is expected to contact with the knitting yarn similarly as in the case of the needle.

That is to say, since the durability of each knitting part can be improved considerably and that only a portion required to be covered to the minimum may be covered with the hard carbon film improve durability described above, it is possible to reduce a required plasma space per knitting part, thereby the productivity being increased markedly.

For example, the present parts can be treated to an extent of several to several tens times in the same plasma space compared with conventional cases where the hard carbon film is applied to almost all surface of each part, thereby enabling a low cost production and sooner wide spreading thereof in the textile industry.

Because of considerable inner film stress of the hard carbon film, a thicker film thickness not always results in a desirable result, and generally the preset film thickness is controlled to 10 μm or less. In view of covering and economic efficiency, a reasonable film thickness is about 2 to 3 μm in the present example.

As is described above, the film thickness of the hard carbon film is effective in a sufficiently thinner range compared with conventional one, and softening, deformation or dimensional change of the base material does not occurred due to a lower film treatment temperature around 200° C., as well as the toughness of the base material is not injured, which makes it possible to design the knitting parts according to the same dimension as conventional ones.

Further, since no steep difference in thickness occurs on the surface of the area where the parts base material is expected to contact with the knitting yarn, the yarn should never be caught to cause hairiness or end breakage thereof. While carbon steel is used as a parts material in the above example, other base material such as stainless steel may also be employed. Still further, it is not restricted to directly cover the base material of various kinds of knitting parts with the hard carbon film, but is possible to form many kinds of plated layers or intermediate layers on the surface of the parts base material followed by applying the hard carbon film thereon so as to increase an adhering property of the hard carbon film or improve an anti-corrosive property of the parts base material.

Furthermore, although the DC plasma CVD method (DC-P-CVD method) has been exemplified as a process for forming the hard carbon film, the film formation is not restricted by such a method but other thin film forming method such as a radio frequency plasma CVD method (RF-P-CVD method) may be used. A hard carbon film in which a part of hydrogen contained in the film is substituted by fluorine or a composite film with other material is also adaptable.

A manner to conduct a vapor phase film formation by keeping a constant distance between the parts material and the mask has been described as a method to gradually decrease the film thickness of the covering from a surface required to cover to a surface not required to do so in the above example. Such a method, however, is not restricted by the manner described above, but a tapered mask or the like may be used to change a superficial distance between the mask and the parts base material on the basis of a located position.

The important thing is to form a to having a smooth gradient of change film from a surface required to cover with the hard carbon film to a surface not required to do so.

According to this invention, as has been described above, durability of the knitting parts of knitting machine such as a needle, guide, tongue, separator, jacquard guide needle and the like is markedly improved and a time period required to replace these knitting parts in the knitting machine can be postponed, thereby considerably increasing an operating efficiency of the knitting machine while decreasing the cost of knit products.

Further, since no steep difference in thickness occurs on the surface of the area where the parts base material is expected to contact with the knitting yarn, the yarn should never be caught to cause hairiness or end breakage thereof. Moreover, the covering of the hard carbon film is formed on not almost all of surface of the knitting parts but a portion thereof required to cover to the minimum, thereby improving the productivity and enabling a cheaper offering and a sooner wide-spreading thereof to the textile industry.

What is claimed is:

1. An improved knitting machine having a plurality of parts each of said parts having at least a portion thereof in contact with knitting yarn when the parts are connected to the knitting machine to perform knitting, at least one of said plurality of parts including an outer surface covering of hard carbon film having a preset film thickness on a portion of the surface of a base material of the part frequently in contact with the knitting yarn, the improvement comprising:

a film thickness changing area found on the surface of said parts where a thickness of the hard carbon film decreases gradually in a direction from an area where the covering of the hard carbon film having the preset thickness is formed to an area where said outer surfaces covering is not formed on the surface of said parts.

2. An improved knitting machine as recited in claim 3, in which a ratio between a length of said film thickness changing area in the thickness changing direction along the surface of said each of said parts and the preset film thickness of said hard carbon film is at least 5:1.

* * * * *

UNITED STATES PATENT AND TRADEMARK OFFICE

CERTIFICATE OF CORRECTION

PATENT NO.: 5,546,770
DATED : August 20, 1996
INVENTOR(S): Takanori NANYA

It is certified that error appears in the above-identified patent and that said Letters Patent is hereby corrected as shown below:

Column 7, line 3, delete "surfaces" and insert therefor --surface--.

line 5, delete "recited in claim 3" and insert therefor --recited in claim 1--

Signed and Sealed this

Thirty-first Day of December, 1996

*Attest:*

*Attesting Officer*

BRUCE LEHMAN

*Commissioner of Patents and Trademarks*